United States Patent [19]

Van Nocker

[11] 3,980,241

[45] Sept. 14, 1976

[54] CRUSHER AND CONTROL CIRCUIT THEREFOR

[75] Inventor: Melvin Van Nocker, Kalamazoo, Mich.

[73] Assignee: Prab Conveyors, Inc., Kalamazoo, Mich.

[22] Filed: May 27, 1975

[21] Appl. No.: 580,799

[52] U.S. Cl. ..... 241/33; 241/36

[51] Int. Cl.[2] ..... B02C 25/00

[58] Field of Search ..... 241/33, 36

[56] References Cited

UNITED STATES PATENTS

| | | | |
|---|---|---|---|
| 2,594,974 | 4/1952 | Mylting | 241/36 |
| 2,678,775 | 5/1954 | Simmons | 241/36 |
| 3,545,684 | 12/1970 | Ruspino et al. | 241/33 |
| 3,623,673 | 11/1971 | Math et al. | 241/36 |

*Primary Examiner*—Granville Y. Custer, Jr.
*Attorney, Agent, or Firm*—Dressler, Goldsmith, Clement, Gordon & Shore, Ltd.

[57] ABSTRACT

Apparatus for crushing swarf and like materials having a circuit for controlling the operation thereof which provides for operating the crusher for selected time durations in order to insure processing of a load of material, and including means for temporarily interrupting the operating cycle in response to any of a plurality of abnormal conditions and for shutting down the crusher if the abnormal conditions are not corrected within a predetermined time interval.

9 Claims, 3 Drawing Figures

10
34
32a
44
30
32
32b
14
16
24
22
29
20
26
42
12
18
40
36
28

128-2
130-1
134-4
134a
134b
L'
M'
N'
O'
P'
Q'
R'
134-2
134c
132
134-1
132a
134-3
136-1
44
138
132b
138-1
156
114-3
148
142
144-1
140
146-1

CONVEYOR MOTOR
CRUSHER MOTOR 100
102
104
106
108
110
112
114-1
114-2
114-3
116
118
118-1
118-2
118-3
118a
120
122
122-1
124
125
125-1
126
128
128-1
128-2
129
130
130-1
132
132a
132b
132-1
134
134a
134b
134c
134-1
134-2
134-3
136
136-1
138
138-1
138-2
140
140-1
140-2
142
144
144-1
146
146a
146-1
148
150
150a
150-1
150-2
150-3
154
154-1
154-2
155
156
158
38
28
42
44

CRUSHER AND CONTROL CIRCUIT THEREFOR

BACKGROUND OF THE INVENTION

The present invention relates to swarf crushers and similar structures in which material to be crushed is supplied to the crusher, typically through a supply hopper supported thereon. It is convenient to operate such crushers for a selected time period which is sufficient to process a load of material but at the same time limits operation to avoid operating the crusher after a load of material has been processed.

As can be expected, during operation of such an apparatus, certain abnormal conditions can which require interruption of the operating cycle. One such typical condition is a stoppage of the crusher because, for example, the crusher is jammed by material even though the motor remains energized. Typically, existing structures are designed to overcome such stoppages by temporarily reversing the crusher and then recommencing operation with the expectation that the cause of the stoppage or the jam will be removed by this cycling. Unfortunately, this is not always the case and in existing structures the cycling continues until the crusher is manually shut down which can result in unnecessary wear and tear of component parts and the control circuit.

In addition, the operating time period continues to run during such abnormal conditions and therefor, in effect, the operating period is shortened by an amount equivalent to the periods of interruption due to the abnormal conditions.

SUMMARY OF THE INVENTION

In accordance with the present invention, there is provided a crusher for swarf and similar material in which the crusher is operated for a selected time period, in which operation of the crusher may be interrupted in response to the existance of abnormal conditions and in which the crusher may be shut down automatically if the abnormal conditions are not corrected during the period of interruption.

In addition, when such crushers are utilized in conjunction with the discharge conveyors, additional sensing means is provided to interrupt operation of the crusher when excess accumulation of material occurs on the discharge hopper, to coordinate the operation of the crusher with the discharge hopper.

In conjunction with the interruption of the crusher in response to abnormal conditions, including excess material accumulation at the discharge hopper, the operating time period is also suspended during such interruptions so that the crusher operating period remains uneffected by the interruptions, to insure that the selected operating time is not dissipated during the interruption intervals of interruption and that the crusher will operate for the selected operating period.

More specifically, in accordance with the present invention, there is provided a control circuit for crushing apparatus of the type described including circuit means responsive to various abnormal conditions for interrupting operation of the crusher. The circuit means is responsive to stoppage of the crusher while the motor is energized, to initiate a stoppage or jam cycle reversing the crusher temporarily. If, after a plurality of such jam cycles or temporary interruptions and reversals of the crusher, the cause of the stoppage is not corrected, the crusher is shut down to prevent damage to components.

Furthermore, material sensing means is provided in a discharge hopper adjacent to the point of discharge of material from the crusher to sense an accumulation of material at that point. The crusher control circuit is responsive to accumulation of excess material for temporarily terminating operation of the crusher to allow the discharge conveyor to carry away the accumulated material at which point in time the crusher is re-energized.

In connection with the interruption of the crusher because of these and other abnormal conditions, the duration of operation which would otherwise be shortened by a time period corresponding to the interval of interruption, may be suspended to insure that the actual operating time of the crusher substantially corresponds to the desired and selected time period to provide for processing of a load of material in the crusher as desired.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

DETAILED DESCRIPTION OF SPECIFIC EMBODIMENTS

Figure 1:
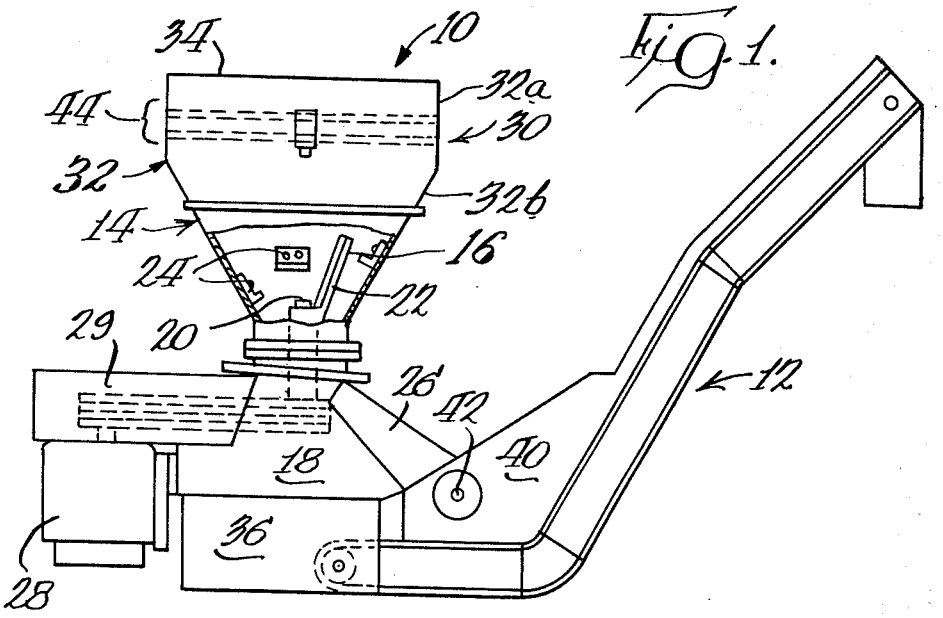
FIG. 1 is a diagrammatic view of a crushing apparatus incorporating the present invention.

While this invention is susceptible of embodiment in many different forms, there is shown in the drawings and will herein be described in detail a preferred embodiment of the invention and modifications thereof, with the understanding that the present disclosure is to be considered as an exemplification of the principles of the invention and is not intended to limit the invention to the embodiments illustrated. The scope of the invention will be pointed out in the appended claims.

FIG. 1 shows one embodiment of a swarf crusher 10 and a discharge conveyor 12. This type of crusher is manufactured, for example, by Morgardshammar AB, of Sweden under the trademark ARBOGA. Such crushers are primarily intended to crush swarf, i.e., turnings of carbon steel, stainless steel, other alloyed steels, aluminum alloys, sponge iron, titanium and uranium although it may be used to crush other types of materials such as, e.g., plastics and glass.

The crusher 10 includes a generally conical crushing chamber 14 defined by a generally downwardly and inwardly tapered sidewall 16 and is open at the top for receiving material to be crushed. The open bottom of the crushing chamber 16 is supported on a suitable stand or base portion 18 through which extends a drive shaft 20 to which is affixed a crusher head 22. The crusher head 22 is rotated on the drive shaft and cooperates with stationary crusher members or cutters 24 affixed to the inner surface of the crushing chamber sidewall 16.

The open bottom of the crushing chamber 14 communicates with a discharge chute 26 affixed to and/or incorporated as a part of the base portion 18 for providing a discharge path for crushed material. The drive shaft 20 is driven by an electric motor 28 connected thereto through a suitable drive train 29.

Material to be crushed is introduced to the crushing chamber 14 through a material receiving and storage hopper 30 disposed above and supported on the crushing chamber 14. As seen in FIG. 1, the hopper 30 is formed by a sidewall 32 including an upper cylindrical sidewall portion 32*a* and a lower conical sidewall portion 32*b* which merges with the conical sidewall 16 of the crushing chamber 14. The hopper 30 which communicates through its open bottom with the crushing chamber 14, has an open top 34 for receiving material to be crushed.

Figure 2:
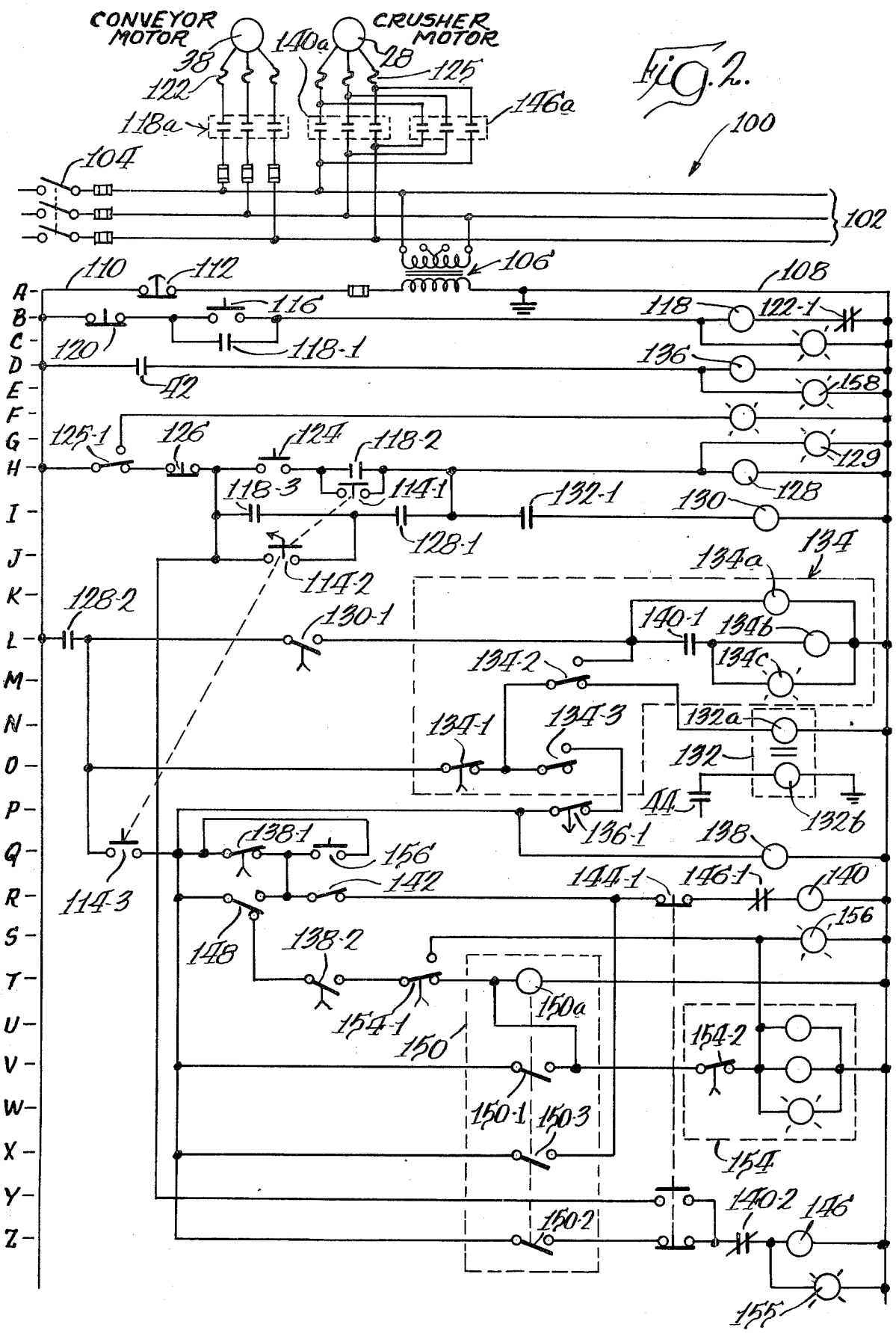
FIG. 2 is a diagram of a circuit for controlling operation of the crusher.

In the embodiment shown in FIG. 1, the base of the crusher is supported on a conveyor housing 36 disposed at one end of the discharge conveyor 12 driven by conveyor motor 38 (FIG. 2). A pair of spaced material retaining walls 40 (only one being shown) are disposed on either side of the conveyor 12 adjacent to the discharge chute 26 for retaining material deposited on the discharge conveyor 12.

A proximity switch 42 may be mounted in one of the conveyor retaining walls 40 for sensing an accumulation of crushed material on the conveyor 12 adjacent to the end of the discharge chute 26 and forms a part of the crusher control circuit (described in more detail below). The proximity or high level sensing switch 42 is operative to temporarily stop the crusher 10 thereby permitting the conveyor 12 to transport material away from the discharge chute 26 and prevent excessive accumulation of crushed material in the area adjacent to the high level switch 42 which might result in the material backing up into the crusher and inhibiting proper operation thereof or overflow of the material from the conveyor.

Typically, and in order to maximize the effeciency of operation of the crusher, the crusher is operated for a selected time interval which is sufficient to process a load of material disposed in the hopper 30 and crushing chamber 14. A level sensing mechanism 44 is provided in the hopper 30. The sensing mechanism 44 effectively operates as a level switch enabling the control circuit for the crusher when material in the hopper 30 reaches a selected level. The sensing mechanism 44, or the portion thereof disposed within the hopper 30, is adapted to be engaged by material in the hopper 30 when the hopper is filled to the selected level, thereby enabling the control circuit and permitting operation of the crusher 10.

The control circuit 100 enabled by the sensing mechanism 44 is shown in FIG. 2.

The crusher motor 28 and the discharge conveyor motor 38 are connected through a main power line 102 to a suitable source (not shown) through a main power disconnect switch 104. The source is conveniently a three phase 440 volt source. The main power line 102 is connected to a crusher motor 28 and the discharge conveyor motor 38 through appropriate contactors.

The main power line 102 is also connected to the primary of a transformer 106. The secondary of the transformer 106 is connected to a pair of main buss lines 108, 110 for supplying power to the control circuit 100. A manually operated master stop switch 112 is connected in one of the main buss lines 110 for manually disconnecting the control circuit 100 from the power line 102.

The control circuit 100 permits two modes of operation of the crusher, a run mode and a maintenance mode, determined by the run/maintenance switch which is a two position switch having a first pair of contacts 114-1 (line H), a second pair of contacts 114-2 (line J) and a third pair of contacts 114-3 (line Q). In FIG. 2, the contacts of the run/maintenance switch are shown open which is in the run position. In order to avoid an undesired accumulation of crushed material at the conveyor, when one is used, the crusher can not be started when the switch is in the position shown, unless the discharge conveyor 12 is running. The control circuit 100 also precludes operation of the crusher 10 unless there is a sufficient amount of material in the hopper 30 to engage the sensing mechanism 44 and thereby enable the control circuit 100.

In addition, the control circuit 100 is effective to preclude operation of the crusher 10, or at least temporarily interrupt operation of the crusher, when there is an excessive accumulation of crushed material on the discharge conveyor 12 adjacent the discharge chute 26 all of which will be explained below.

When the run/maintenance switch is in the maintenance position, i.e., the contacts 114-1, 114-2 and 114-3 are closed, permitting the crusher 10 to be started independently of the conveyor 12, without material in the hopper 30, and independently of any accumulation of material on the discharge conveyor 12.

In order to initiate operation of the crusher when the contacts 114-1, 114-2 and 114-3 of the run/maintenance switch are in the position shown in FIG. 2, it is first necessary to start the conveyor 12 by closing the conveyor start switch 116 (line B). This energizes the conveyor motor starting coil 118 through the normally closed conveyor stop switch 120 and the normally closed conveyor overload contact 122-1 (all in line B). The contact 122-1 is operated by the conveyor overload relay coil 122 in the motor circuit.

When energized, the conveyor motor start coil 118 closes the contacts 118*a* of the contactor conveyor motor circuit, the normally open holding contacts 118-1 (line C) to maintain the starter coil 118 energized after release of the start switch 116, the normally open contacts 118-2 (line H) to enable crusher start switch 124, and normally open contacts 118-3 (line I) which operate as part of a bypass circuit to keep the crusher operating after it is started.

To start the crusher, the crusher forward start switch 124 (line H) is closed to complete a circuit through the now closed contacts 118-2, the normally closed contacts 125-1 of the crusher overload relay 125, and the normally closed crusher stop switch 126, to energize start relay coil 128 and the pilot light 129 connected across the start relay coil 128. The overload relay 125 is in the crusher motor circuit. When the start relay coil 128 (line H) is energized, it closes a first set of normally open contacts 128-1 (line I) which are connected in series with the contacts 118-3, closed when the conveyor motor coil 118 was energized, to bypass the crusher forward start switch 124 and maintain the start relay coil 128 energized after release of the start switch 124.

The start switch 124 and bypass circuit including contacts 118-3 and 128-1 are also connected to the timing relay coil 130 (line I) through the normally open contacts 132-1 of the level sensing relay 132 (lines N and O). Contacts 132-1 are closed when the relay 132 is energized in response to closure of the level sensing mechanism 44 in the hopper 30.

The energized start relay 128 also closes a set of normally open contacts 128-2 (line L) to enable the balance of the control circuit 100. Closure of the start relay contacts 128-2 completes a circuit (line O) to the primary coil 132*a* of the level sensing induction relay 132 through the normally closed contacts 134-1 (line O) and 134-2 (line M) of the duration timer 134. The crusher 10 will begin to operate if the level sensing mechanism 44 connected to the secondary 132*b* of the level sensing relay 132 is closed, thereby closing the relay contacts 132-1 (line I) to energize the timing relay 130.

As explained below, the crusher 10 will continue to operate until the duration timer 134 times out, until the crusher 30 becomes jammed, until the motor 28 becomes overloaded, or until excess material accumulates on the discharge conveyor 12.

When the timing relay 130 (line I) is energized through the closed level relay contacts 132-1, the normally open timing relay contacts 130-1 (line L) will close approximately five seconds after the timing relay coil 132 is energized. This time delay prevents material being introduced into the hopper 30 and momentarily engaging the sensing mechanism 44 from energizing the crusher. In other words, the material must close mechanism 44 for a period of approximately five seconds, a good indication that the hopper is filled to the selected level, before the crusher will start.

When the timing relay contacts 130-1 (line L) close, the duration timer 134 is energized. The duration timer 134 includes a clutch 134*a*, which operates instantaneous timer contacts 134-2 (line M) and instantaneous contacts 134-3 (line O), and a timer motor 134*b* which operates delayed contacts 134-1 (line O). In addition, a timer pilot light 134*c* is connected across the motor 134*b* to show when the timer 134 is in operation.

Thus, upon energizing the duration timer 134, the instantaneous contacts 134-2 (line M) shift from the normally closed to the normally open position to de-energize the primary 132*a* of the running level relay 132 and to maintain the duration timer 134 energized. When the primary 132a of the running level induction relay 132 is de-energized, the induction relay contacts 132-1 (line I) open to de-energize the timing relay coil 130, thereby opening the timing relay contacts 130-1 (line L).

The second set of instantaneous duration timer contacts 134-3 (line O) also shift to the normally open position to energize through the normally closed conveyor high level relay contacts 136-1 (line P) a second timing relay coil 138 (line Q) and the crusher forward motor coil 140 (line R) through the normally closed second timing relay contacts 138-1 (line Q), the normally closed contacts of a first crusher run sense switch 142, the normally closed contacts 144-1 of a manual reverse jog switch and the normally closed contacts 146-1 of the reverse motor coil 146.

When the forward motor coil 140 is energized, it closes the contacts 140*a* of the crusher motor connector to initiate forward rotation of the crusher motor 28, and closes contacts 140-1 (line L) to start the duration timer motor 134*b*, and also opens the normally closed contacts 140-2 (line Z) to preclude energizing the reverse motor coil 146.

When the crusher begins to operate, a second crusher run sense switch 148 (line R) moves from the normally closed to the normally open position to bypass the normally closed contacts 138-1 of the second timing relay 138 which contacts open approximately 4 seconds after the second timing relay 138 is energized. This delay permits the second run sense switch 148 to shift to the normally open position.

The energized second timing relay 138 also closes normally open contacts 138-2 (line T) after an approximate 4 second delay to enable the jam control and timing circuit, to be described in more detail below.

In normal operation, the forward motor coil 140 (line R) will remain energized and the crusher will continue to run until the duration timer 134 times out. At the end of the timing interval, which is adjustable, the duration timer 134 times out opening the delayed contacts 134-1 (line O). When the delayed duration timing contacts 134-1 open, the duration timer clutch 134*a* is de-energized. As a result, the instantaneous duration timer contacts 134-2 and 134-3 return to their normally closed position to de-energize the forward motor coil 140 and to enable the primary coil 132*a* of the running level relay 132.

When the clutch 134*a* is de-energized, the delayed duration timer contacts 134-1 are reset to complete the circuit through the primary coil 132*a* of the running level relay 132. When the crusher stops, the second run sense switch 148 returns to its normally closed position, but the jam timer is not energized since the second timing relay 138 has also been de-energized when timer contacts 134-3 (line O) return to their normally closed position.

Since the start relay coil 128 (line H) and the conveyor motor coil 118 (line B) remain energized, the control circuit 100 will recycle when the hopper is filled to the level sufficient to close the running sensing mechanism 44 in the secondary 132*b* of the running level relay 132, thereby again closing the relay contacts 132-1 (line I) to repeat the cycle described above.

If the crusher 10 becomes jammed, the drive shaft 20 will stop even though the forward motor coil 140 is energized. When this occurs, the centrifugal type second run sense switch 148 (line R) returns to its normally closed position. This results, when timing relay contacts 138-1 (line Q) are opened, in de-energizing the forward motor coil 140, thereby opening the contacts 140-1 (line L) temporarily terminating operation of the duration timer motor 134*b* to interrupt the timing cycle, and closing the contacts 140-2 (line Z) to the reverse motor coil 146.

Since the second timing relay coil 138 (line Q) remains energized, thereby closing contacts 138-2 (line T), the normally closed contacts of the run sense switch 148 complete a circuit through the motor 150*a* (line T) of a jam cycle timer 150. The jam cycle timer motor 150*a* when energized controls the operation of three cam operated switches 150-1 (line V), 150-2 (line Z), and 150-3 (line X). The first switch 150-1 closes approximately 1.8 seconds after the cycle timer motor 150*a* is energized to maintain the motor 150*a* energized, and to complete a circuit to jam duration timer 154. The switch 150-1 remains closed for approximately nine seconds, the jam timing cycle.

The second cycle timing switch 150-2 closes at about the same time as the first switch 150-1 to energize the reverse motor coil 146 and pilot light 155 connected across the motor coil 146. When the reverse motor coil 146 is energized, it closes contacts 146*a* in the crusher motor circuit and opens normally closed contacts 146-1 connected in series with the forward motor coil 140 to preclude energization thereof. The second cycle timing switch 150-2 remains closed for approximately 4 seconds so that the crusher will run in reverse for that period of time.

Approximately 5 seconds after the cycle timer 150 is energized, the second switch 150-2 opens and the third cycle timing switch 150-3 is closed to re-energize the forward motor coil 140. The second run sense switch shifts from the normally closed to the normally open position to hold the forward motor starter coil 140 energized. If, as a result of this action, the jam is cleared, the normally open contacts of the second run sense switch remain closed and the crusher will continue to run forward until the duration timer times out as explained above.

The jam cycle timer 150 times out after approximately nine seconds thereby opening the first and third cycles switches 150-1 and 150-3, respectively, and de-energizing the jam timer 150, if the crusher is unjammed and is running in the forward direction. If, however, the crusher is still jammed when the cycle timer runs out, the normally closed contacts of the second run sense switch 148 remain closed, keeping the cycle timer 150 and jam timer 154 energized and repeating the jam cycle.

If after a period of time, for example, approximately three cycles of the cycle timer 150, the crusher is not unjammed, the jam timer 154 will time out opening the delayed contacts 154-1 (line T) and 154-2 (line V) to energize the jam indicator light 156 and maintain the jam timer clutch energized.

Since the forward motor coil 140 is de-energized under these circumstances, the forward motor coil contacts 140-1 (line L) are open to interrupt the duration timer 134. In order to restart the crusher after the jam is cleared, a manual reset switch 156 (line Q) may be closed, or alternatively the entire control circuit may be reset by operating the crusher stop button 126 (line H). If reset, the hopper must be refilled to a sufficient level to close the sensing mechanism 44 and to initiate a complete operating cycle.

If either of the motors 28 or 38 becomes overheated, the corresponding thermal overload relay 122, 125, respectively operates overload contacts 122-1 or 125-1. In either case, the crusher control circuit is de-energized and reset.

Finally, if material accumulates in the crusher discharge conveyor to a high enough level to activate the high level detection switch 42 (line D), the switch is closed to energize the high level relay 136 and high level indicator light 158. The energized high level relay opens the normally closed high level relay contacts 136-1 (line P) to de-energize the second timing relay coil 138 and the forward motor coil 140. When the level of material in the discharge conveyor drops low enough to open the high level proximity switch 42, the high level relay is de-energized. The relay contacts 136-1 close approximately 5 seconds thereafter, thereby allowing the accumulation of material in the conveyor to drop even lower, to re-energize the second timing relay 138, the forward motor coil 140, and the duration timer 134.

Figure 3:
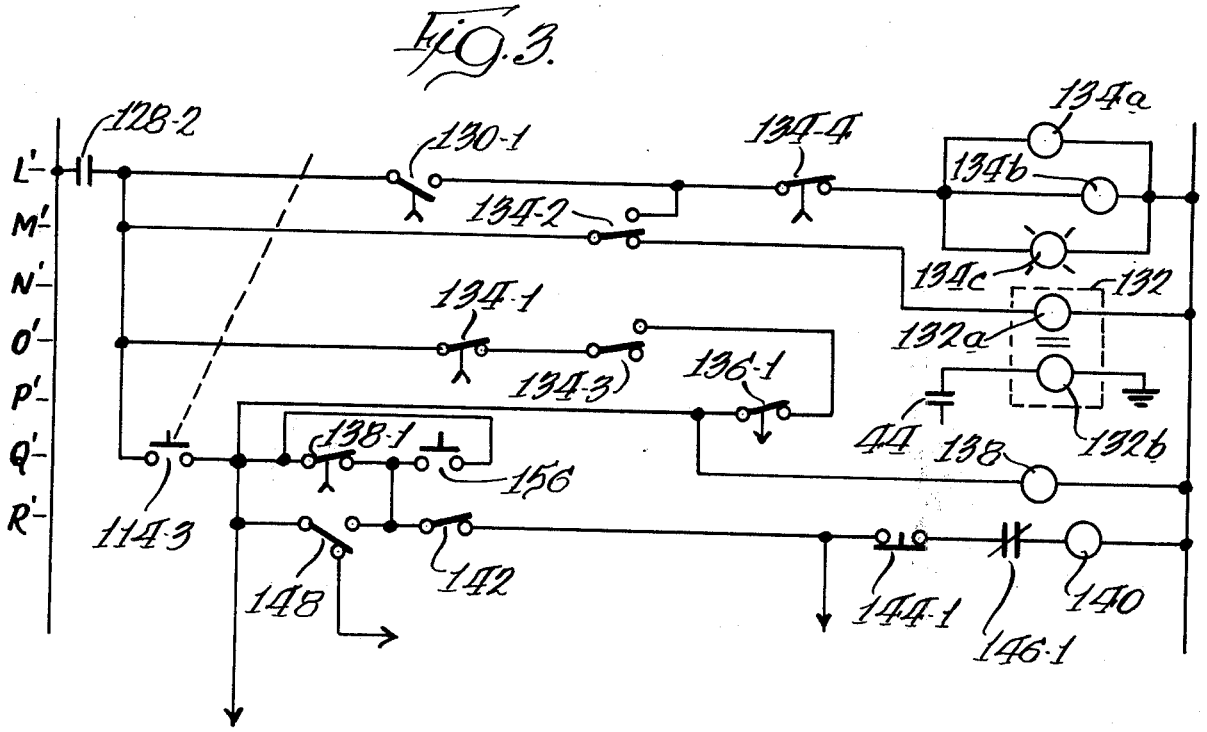
FIG. 3 is a diagram of a modified portion of the circuit of FIG. 2.

In FIG. 3, there is shown an alternative embodiment of a portion of the circuit of FIG. 2 in which the duration timer is not deactivated during interruption of the crusher motor. In the circuit of FIG. 3, the same components as in the corresponding lines of FIG. 3 are utilized with the exception that the duration timer 134 controls the operation of a fourth delay contact 134-4 (line L′). In the FIG. 3 embodiment, however, the various components are wired somewhat differently so that the timer 134 is not interrupted when the forward motor coil 140 is de-energized.

Thus, as can be seen, the duration timer clutch 134*a* is connected across the duration timer motor 134*b* and the fourth, delayed contacts 134-4 of the duration timer 134 are interposed in line L′ between the timer motor and clutch and contacts 134-2 and 130-L. In addition, contacts 134-2 are connected in parallel with contacts 130-1 and 134-1 to one side of normally open contacts 128-2. Finally, the forward motor coil normally open contacts 140-1 have been omitted in line L′.

The operation of the various components of the circuit of FIG. 2 is substantially the same for the modified circuit of FIG. 3 except that when the forward motor coil 140 is de-energized, the operation of the duration timer 134 is not interrupted. As a result, the operating cycle of the timer is foreshortened by whatever time the forward motor coil 140 is de-energized.

In normal operation, as described above, the crusher will operate until the duration timer 134 times out. When this occurs, the normally closed contacts 134-1 (line O′) open deenergizing the forward motor coil 140 and the second timing relay 138. Immediately thereafter, the fourth duration timer contact 134-4 (line L′) open to de-energize the duration timer and effect the resetting of the timer contacts 134-2 (line M′) and 134-3 (line O′) and the subsequent reclosing of the normally closed contacts 134-1 (line O′) and 134-4 (line L′).

Since the contacts 134-1 and 134-4 close after the contacts 134-2 and 134-3 return to their position shown in FIG. 3, the timer remains de-energized because the contacts 134-1 are open and the second timer coil 138 and forward motor coil 140 remain de-energized because contacts 134-3 are in the position shown. Shifting of contacts 134-2 to the position shown in the drawing re-energizes the primary 132*a* of the running level relay 132 which will effect a new operating cycle when the level sensing mechanism 44 in the hopper 30 closes in response to the hopper being filled to the selected level with material to be crushed, as explained above.

Thus, there has been disclosed a crusher and control circuit thereof which controls the operation of the crusher in which the crusher may be interrupted in response to the existance of one or more abnormal conditions occuring, in which the operation of the crusher is subsequently terminated if at least one of those conditions is not corrected, in which one of those conditions may be the accumulation of material on a discharge hopper associated with the crusher, and in which the timing and operating interval of the crusher may be suspended during interruption of the crusher so that the crusher operates for the full selected time period.

From the foregoing, it will be observed that numerous variations and modifications may be effected without departing from the true spirit and scope of the novel concept of the invention. It is, of course, intended to cover by the appended claims all such modifications as fall within the scope of the claims.

What is claimed is:

1. Apparatus for crushing swarf and like materials comprising:

a crushing chamber for the material to be crushed, said crushing chamber having a loading opening to receive the material to be crushed and having means for discharging crushed material;

crushing means disposed within said crushing chamber;

bi-directional motor means operable in a first direction to drive said crushing means to effect crushing of material within said crushing chamber; and control circuit means connected to said motor means for controlling the operation thereof;

said control circuit means including:

first circuit means operative when energized to operate said motor means in said first direction;

selectively energizable second circuit means operative when energized to energize said first circuit means and effect operation of said motor means in said first direction;

third circuit means energized in response to stoppage of said crushing means while said first circuit means is energized for alternately and repeatedly de-energizing and reenergizing said first circuit means to effect termination of said stoppage; and fourth circuit means energized in response to said stoppage of said crushing means for de-energizing said third circuit means if said stoppage is not terminated within a selected time interval.

2. Apparatus as claimed in claim 1 including:

fifth circuit means responsive to normal operation of said crushing means for maintaining said first circuit means energized during normal operation of said apparatus and responsive to said stoppage of said crushing means for de-energizing said first curcuit means and for energizing said third and fourth circuit means.

3. Apparatus as claimed in claim 2 wherein:

said fifth circuit means is further responsive to termination of said stoppage of said crushing means for de-energizing said third and fourth circuit means.

4. Apparatus as claimed in claim 1 wherein:

said third circuit means includes:

cyclical timing means energized in response to said stoppage of said crushing means; and a plurality of switch means cyclically operated in response to energization of said cycle timing means, one of said switch means being connected to said first circuit means for effecting energization thereof when said one switch means is operated.

5. Apparatus as claimed in claim 4 including:

additional circuit means operative when energized to operate said motor means in a second direction;

and wherein:

another of said cyclically operated switch means is connected to said additional circuit means and is operated alternately with said one switch means;

whereby said cyclical timing means effects alternate operation of said motor means in said first and second directions to effect termination of said stoppage.

6. Apparatus as claimed in claim 1 including:

additional circuit means operative when energized to operate said motor means in a second direction and wherein:

said third circuit means is further responsive to said stoppage of said crushing means for alternately energizing said additional circuit means and said first circuit means;

whereby said motor means is alternately operated in said first and second directions to effect termination of said stoppage.

7. Apparatus as claimed in claim 1 including:

sensing circuit means activated in response to excess accumulation of crushed material discharged from said apparatus; and means responsive to said actuated sensing circuit means for de-energizing said first circuit means.

8. Apparatus as claimed in claim 1 wherein:

said second circuit means includes:

timing means energized in response to energization of said first circuit means for determining the period of time said first circuit means is energized and for de-energizing said first circuit means at the end of said time period; and timing circuit control means responsive to de-energization of said first circuit means for interrupting operation of said timing circuit means and responsive to re-energization of said first circuit means for re-energizing said timing means;

whereby said first circuit means is energized for said time period.

9. Apparatus for crushing swarf and like materials comprising:

a crushing chamber for the material to be crushed, said crushing chamber having a loading opening to receive the material to be crushed and having means for discharging crushed material;

crushing means disposed within said crushing chamber;

motor means operable when energized to drive said crushing means to effect crushing of material within said crushing chamber; and circuit means connected to said motor means for controlling the operation thereof;

said control circuit means including:

energizable first circuit means for determining the period of time said motor means operates to drive said crushing means and for de-energizing said motor means at the end of said time period;

second circuit means for interrupting operation of said motor means in response to the occurance of an abnormal operating condition; and third circuit means responsive to said interruption of the operation of said motor means for de-energizing said first circuit means while operation of said motor means is interrupted and responsive to resumption of operation of said motor means for re-energizing said first circuit means;

whereby said motor means operates for said time period independently of any such interruption.

* * * * *

UNITED STATES PATENT AND TRADEMARK OFFICE

CERTIFICATE OF CORRECTION

PATENT NO. : 3,980,241

DATED : September 14, 1976

INVENTOR(S) : Melvin Van Nocker

It is certified that error appears in the above-identified patent and that said Letters Patent are hereby corrected as shown below:

Col. 1, line 14, "can which" should be -- can arise which --.

Signed and Sealed this

Twenty-first Day of December 1976

[SEAL]

*Attest:*

RUTH C. MASON
*Attesting Officer*

C. MARSHALL DANN
*Commissioner of Patents and Trademarks*